US006623835B2

(12) United States Patent
Chang

(10) Patent No.: US 6,623,835 B2
(45) Date of Patent: Sep. 23, 2003

(54) PROTECTIVE PAD

(76) Inventor: Ju-Sung Chang, No. 4, Lane 48, Ming Sun Third Street, Chao Tun Township, Nantou (TW)

( * ) Notice: Subject to any disclaimer, the term of this patent is extended or adjusted under 35 U.S.C. 154(b) by 51 days.

(21) Appl. No.: 09/983,501

(22) Filed: Oct. 24, 2001

(65) Prior Publication Data

US 2003/0077407 A1 Apr. 24, 2003

(51) Int. Cl.[7] ..... B32B 3/10; A41D 13/06; A41D 27/12; A61F 13/06; A61F 13/00

(52) U.S. Cl. ..... 428/138; 2/24; 2/62; 602/23; 602/26

(58) Field of Search ..... 2/24, 22, 23, 60, 2/62; 428/137, 138, 131, 134; 602/23, 26

(56) References Cited

U.S. PATENT DOCUMENTS 3,092,110 A * 6/1963 Duensing ..... 128/293
5,537,689 A * 7/1996 Dancyger ..... 2/24
6,058,505 A * 5/2000 Bettencourt ..... 2/24
6,279,160 B1 * 8/2001 Chen ..... 2/24

* cited by examiner

*Primary Examiner*—Harold Pyon
*Assistant Examiner*—Michael C. Miggins
(74) *Attorney, Agent, or Firm*—Rabin & Berdo, P.C.

(57) ABSTRACT

A protective pad includes an outer surface layer, an inner surface layer, and an anti-impact rubber cushion. The exterior surface of the anti-impact rubber cushion is contoured by a plurality of flexible bumpers that protrude and are internally hollow. A perforation is formed in the top of each flexible bumper and a plurality of ventilation channels are disposed underneath in a crisscrossed arrangement. Furthermore, the ventilation channels and the holes in the flexible bumpers are interconnected. A shock-buffering foam sponge is built into the inner surface layer to augment its impact absorbing capability. An elastic foam sponge having a plurality of aeration holes formed in it is integrated into the outer surface layer to increase air circulation and the dissipation of bodily heat to optimize wearing comfort and safety.

4 Claims, 9 Drawing Sheets

PROTECTIVE PAD

BACKGROUND OF THE INVENTION

1) Field of the Invention

The invention herein relates to a protective pad that effectively reduces the occurrence of joint injury to people and animals.

2) Description of the Prior Art

To prevent injury to people and animals as they exercise or play sports, the best method is to wear protective pads; however, since currently available protective pads are typically heavy, hot and poorly ventilated, incapable of wicking off perspiration, lacking in anti-impact safeguard capacity, and have several other drawbacks, their product practicality is far from ideal and requires improvement.

SUMMARY OF THE INVENTION

The primary objective of the invention herein is to provide a protective pad utilized to shield the joints of people or animals, the most significant features of which includes disposing a plurality of flexible bumpers on the exterior surface of the an anti-impact rubber cushion and forming a perforation in the top of each flexible bumper; furthermore, a shock-buffering foam sponge is built into the inner surface layer to augment impact absorbing capability, while an elastic foam sponge having a plurality of aeration holes formed in it is integrated into the outer surface layer to increase air circulation and the dissipation of body heat to optimize wearing comfort.

DETAILED DESCRIPTION OF THE INVENTION

Referring to FIG. 1, FIG. 2, FIG. 3, and FIG. 4, the protective pad 1 of the invention herein is materially comprised of an outer surface layer 2, an inner surface layer 3, and an anti-impact rubber cushion 5. Furthermore, there are two embodiments of the protective pad 1; the first type is a protective pad structure that consists of assembling the outer surface layer 2 to the inner surface layer 3, while the second type consists of assembling the outer surface layer 2 to the inner surface layer 3, following which the anti-impact rubber cushion 5 is attached onto the outer surface layer 2.

Figure 1:
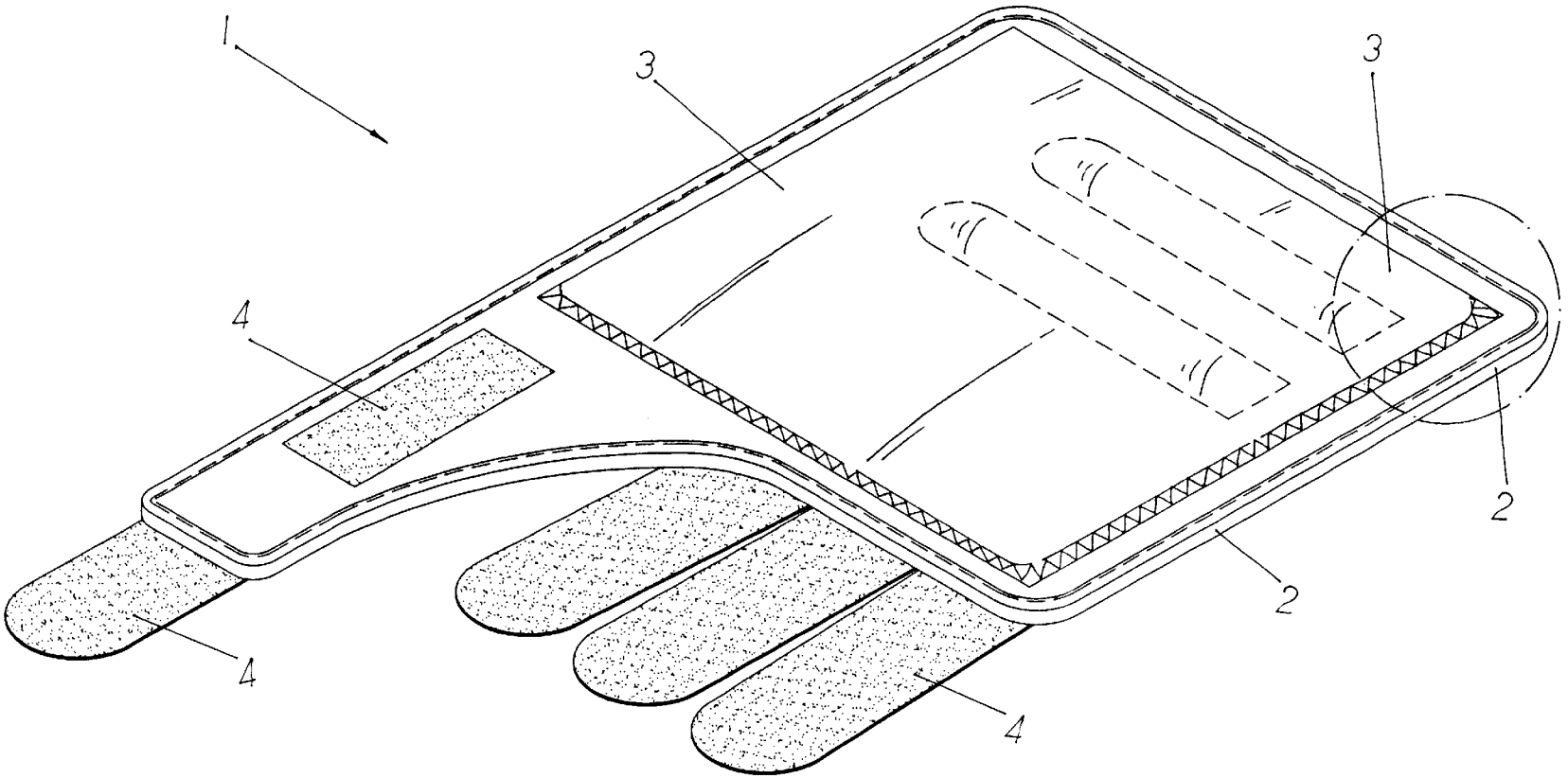
FIG. 1 is an isometric drawing of the invention herein (as viewed from the perspective of the inner surface layer).
Figure 2:
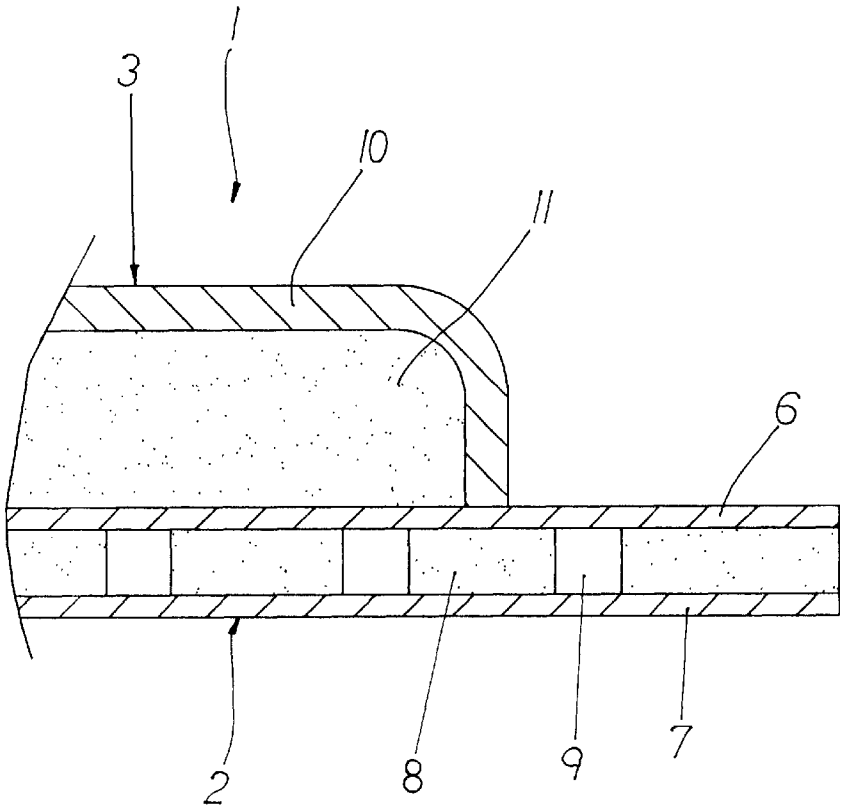
FIG. 2 is a partial cross-sectional drawing of FIG. 1 in a magnified view.
Figure 5:
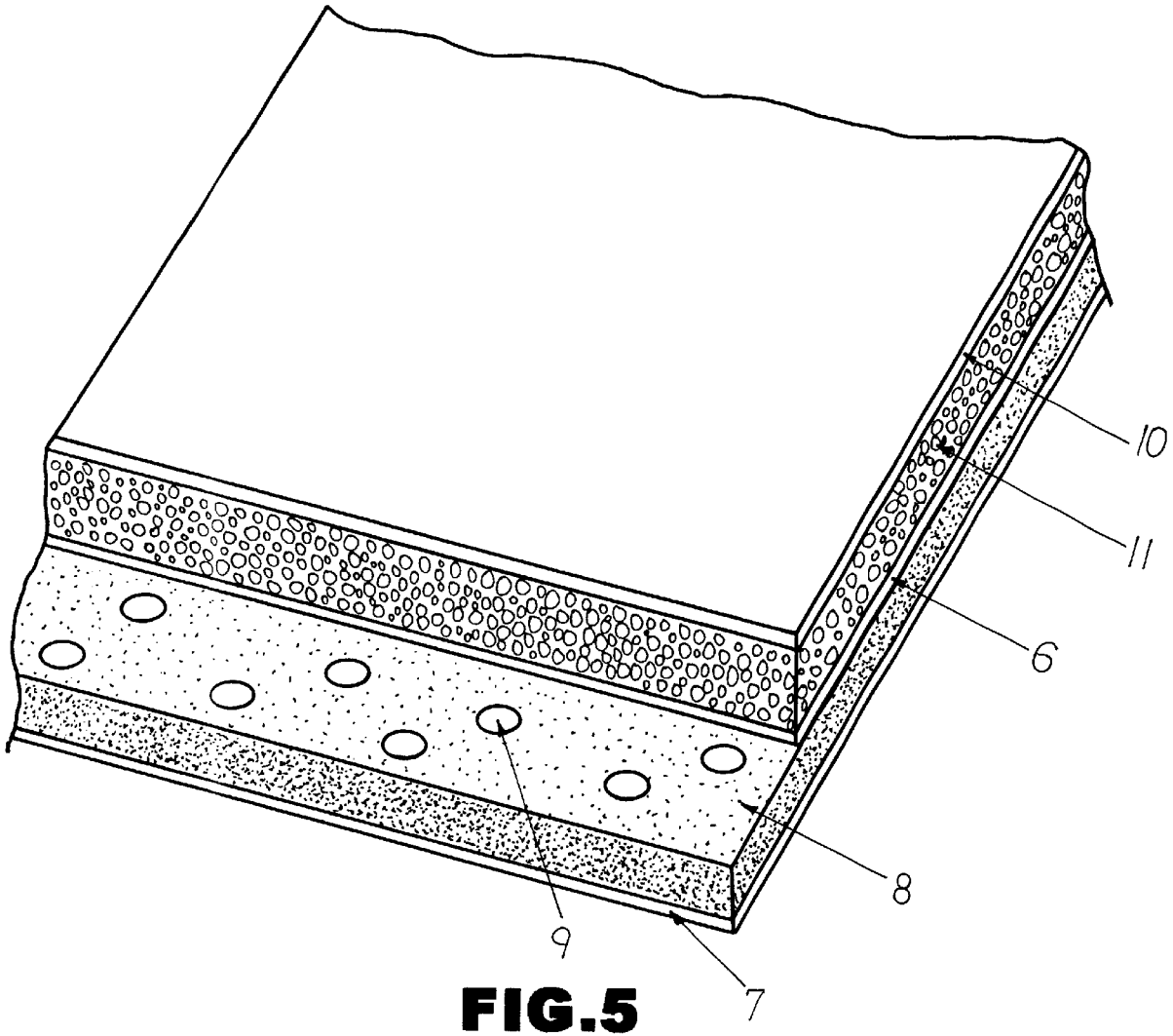
FIG. 5 is an isometric drawing of the layered material structure of the invention herein.

Referring to FIG. 1 and FIG. 2, the structure of the first embodiment, fastener straps 4 are disposed along the side of the protective pad 1 and the outer surface layer 2 is assembled to the inner surface layer 3. The outer surface layer 2 includes an elastic foam sponge 8 cemented between an interior and an exterior fabric 6 and 7. The exterior fabric 7 of outer surface layer 2 has a wool-like surface texture that provides for anchoring the fastener straps 4 to secure the protective pad 1 in position. The elastic foam sponge 8 is designed with a plurality of aeration holes 9 formed in it. The inner surface layer 3 includes a highly absorbent cotton ply 10 cemented around a shock-buffering foam sponge 11 of an appropriate thickness such that the shock-buffering foam sponge 11 of the inner surface layer 3 is sewn to the outer surface layer 2 to fabricate the structure of the protective pad 1. Each layer of material comprising the structure of the fabricated protective pad 1 is illustrated in FIG. 5.

Figure 3:
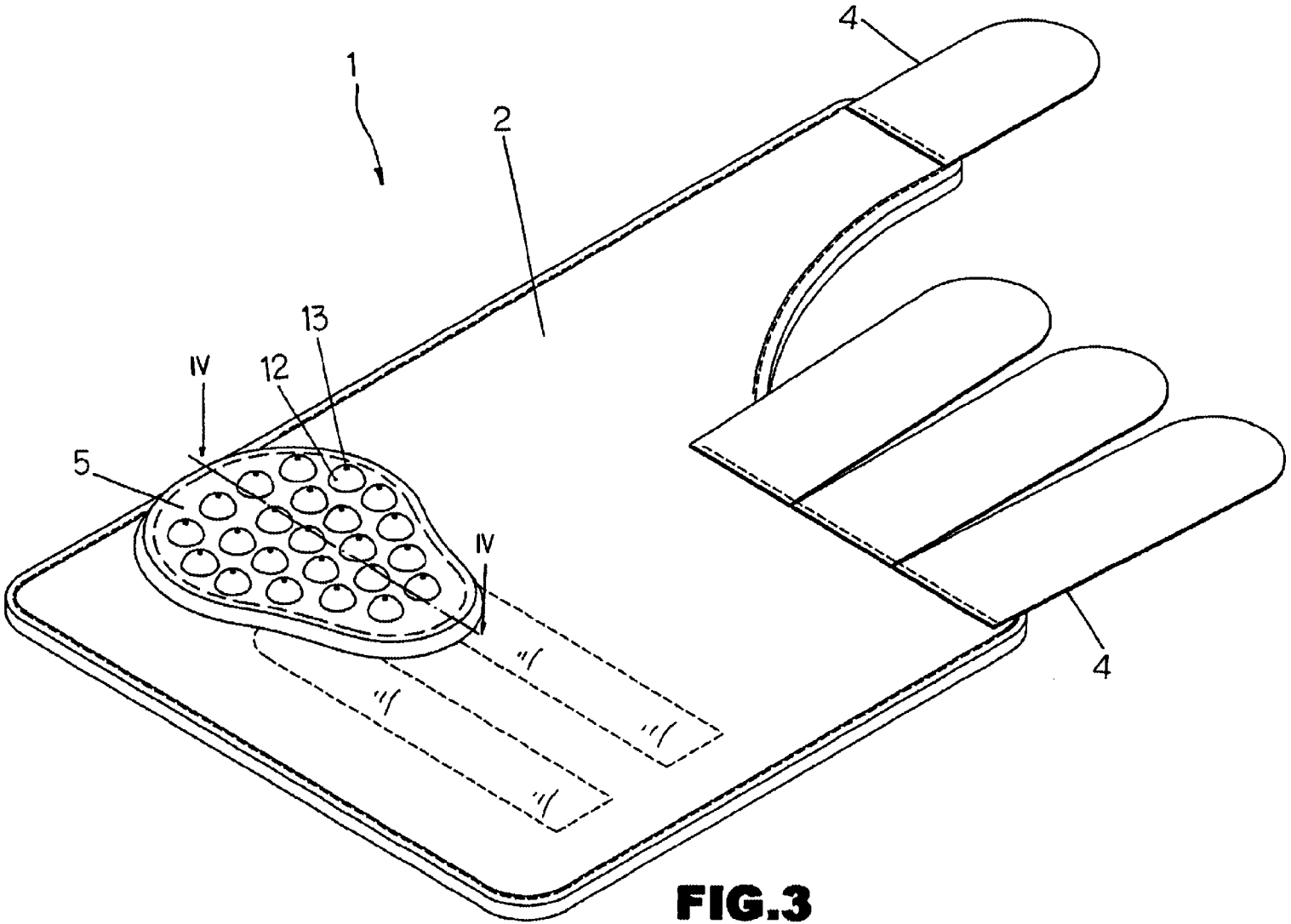
FIG. 3 is an isometric drawing of another embodiment of the invention herein.
Figure 4:
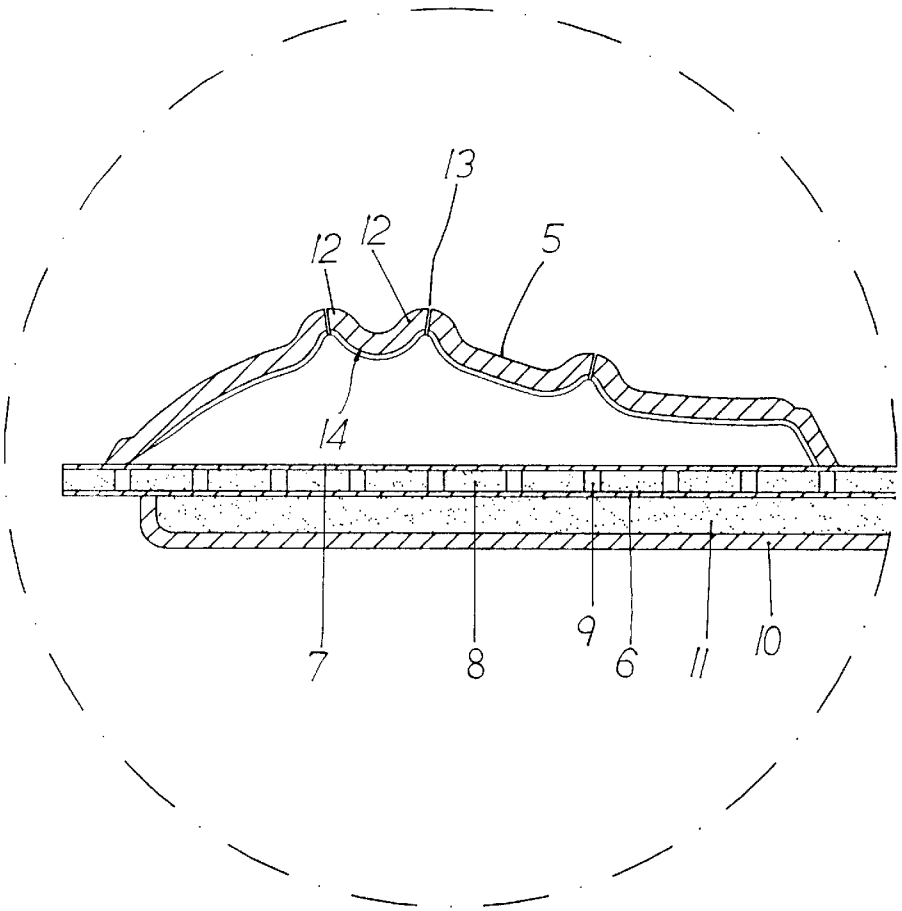
FIG. 4 is a cross-sectional drawing of FIG. 3, as viewed from the perspective of line A—A.
Figure 6:
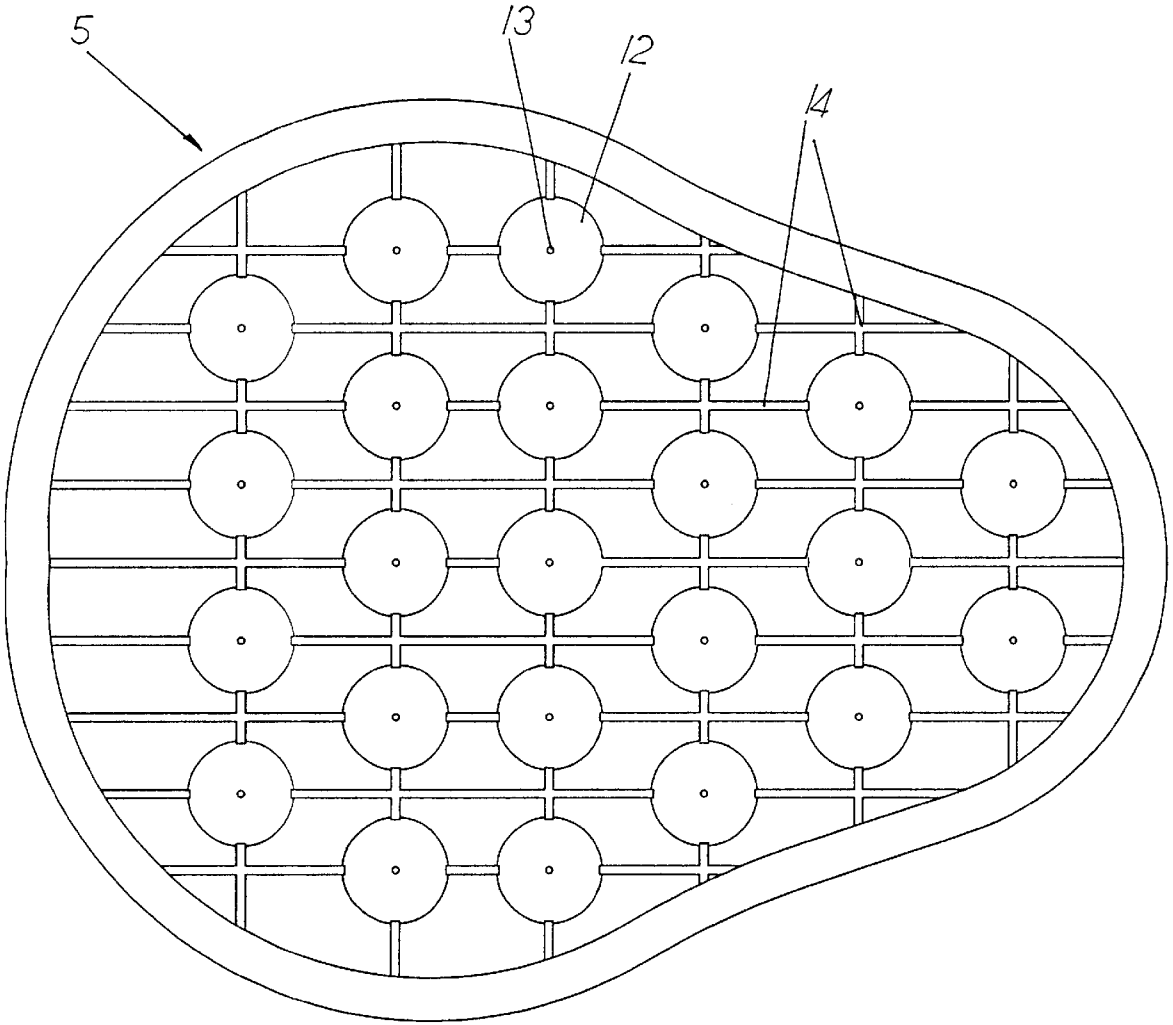
FIG. 6 is an orthographic drawing of the inside of the anti-impact rubber cushion of the invention herein.

In the second embodiment of the protective pad 1, referring to FIG. 3, FIG. 4, and FIG. 6, the structural design of the outer surface layer 2 and the inner surface layer 3 is strongly reinforced to effectively withstand concussion by the addition of an anti-impact rubber cushion 5 onto the outer surface layer 2 of the protective pad 1. The exterior surface of the anti-impact rubber cushion 5 is contoured by a plurality of flexible bumpers 12 that protrude and are internally hollow. A perforation 13 is formed in the top of each flexible bumper 12 and a plurality of ventilation channels 14 are disposed underneath in a crisscrossed arrangement. Furthermore, the ventilation channels 14 and the flexible bumper perforations 13 are interconnected such that when a person or animal is exercising or playing a sport, if a stumble and fall should occur, the flexible bumpers 12 on the anti-impact rubber cushion 5 of the protective pad 1 serve as an initial shield. As the application of force continues, air within the hollow flexible bumpers 12 is discharged through the perforations 13 in their top surfaces and the accompanying shape deformation absorbs the impact force. Following the dispersal of force, air is drawn in through the perforations 13 in the top surface of the flexible bumpers 12 as they rapidly rebound back into original shape. The entire process thereby effectively increasing increases the anti-impact capability of the said protective pad 1.

In the invention herein, the shock-buffering foam sponge 11 is utilized to augment the impact absorbing capability of the invention herein, the plurality of aeration holes 9 in the elastic foam sponge 8 enhances air circulation and the dissipation of bodily heat to optimize wearing comfort and ventilation, and the flexible bumpers 12 additionally disposed on the anti-impact rubber cushion 5 absorb concussive force to effectively reduce the likelihood of joint injury. As such, the present invention effectively safeguards the joints of persons or animals, which is the most significant feature of the present invention.

Figure 7:
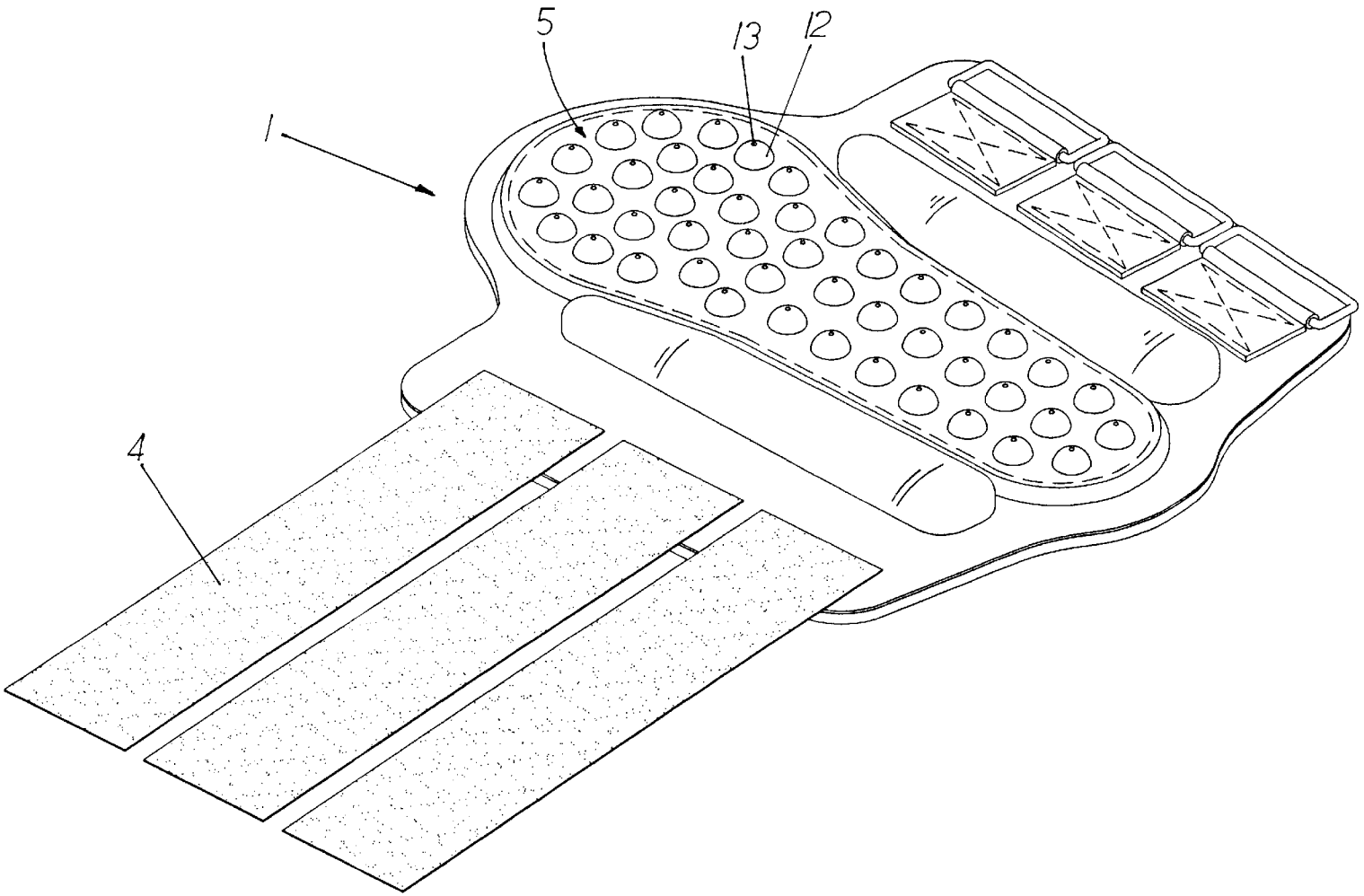
FIG. 7 is an isometric drawing of an embodiment of the invention herein.
Figure 8:
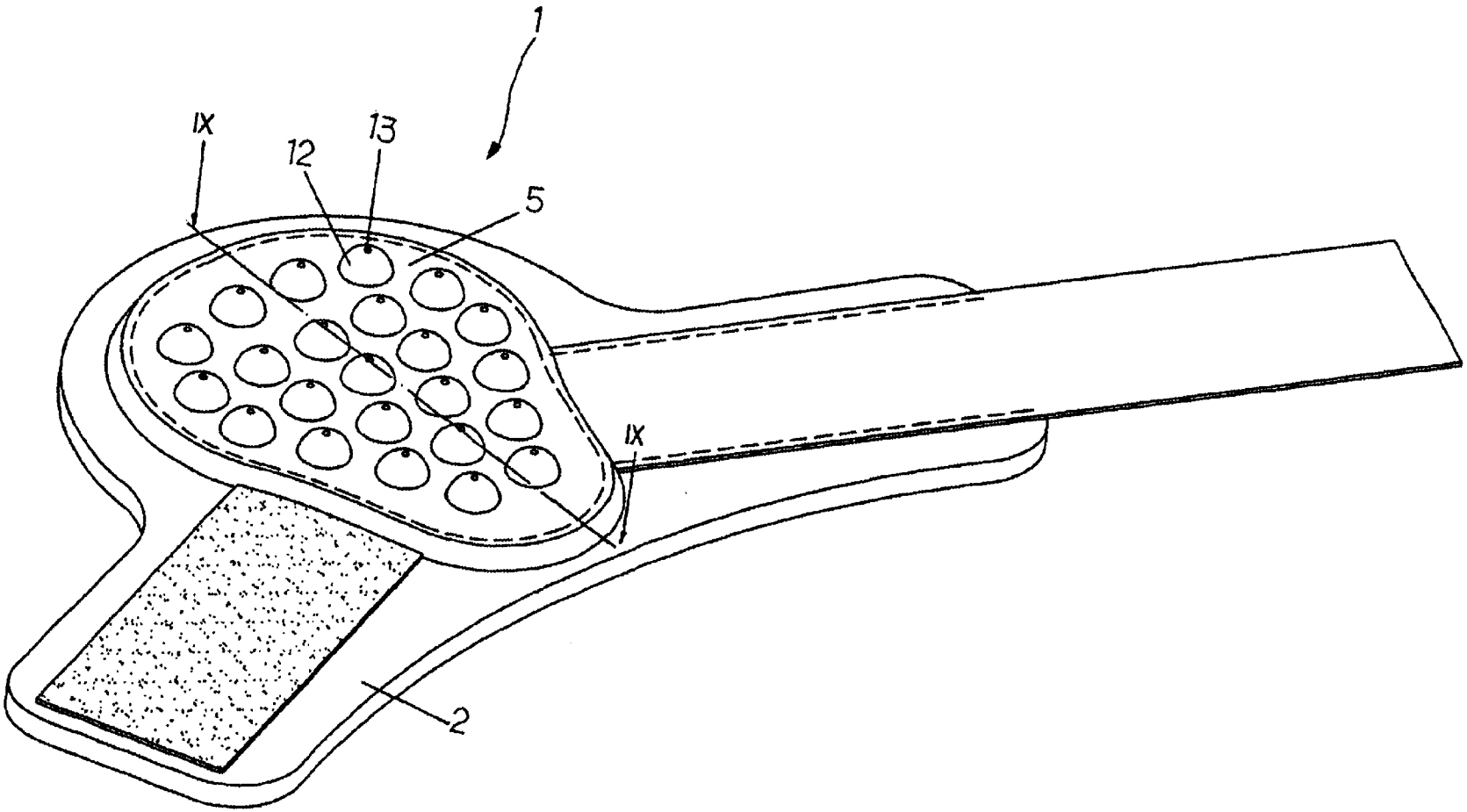
FIG. 8 is an isometric drawing of the anti-impact rubber cushion assembled to the outer surface layer.
Figure 9:
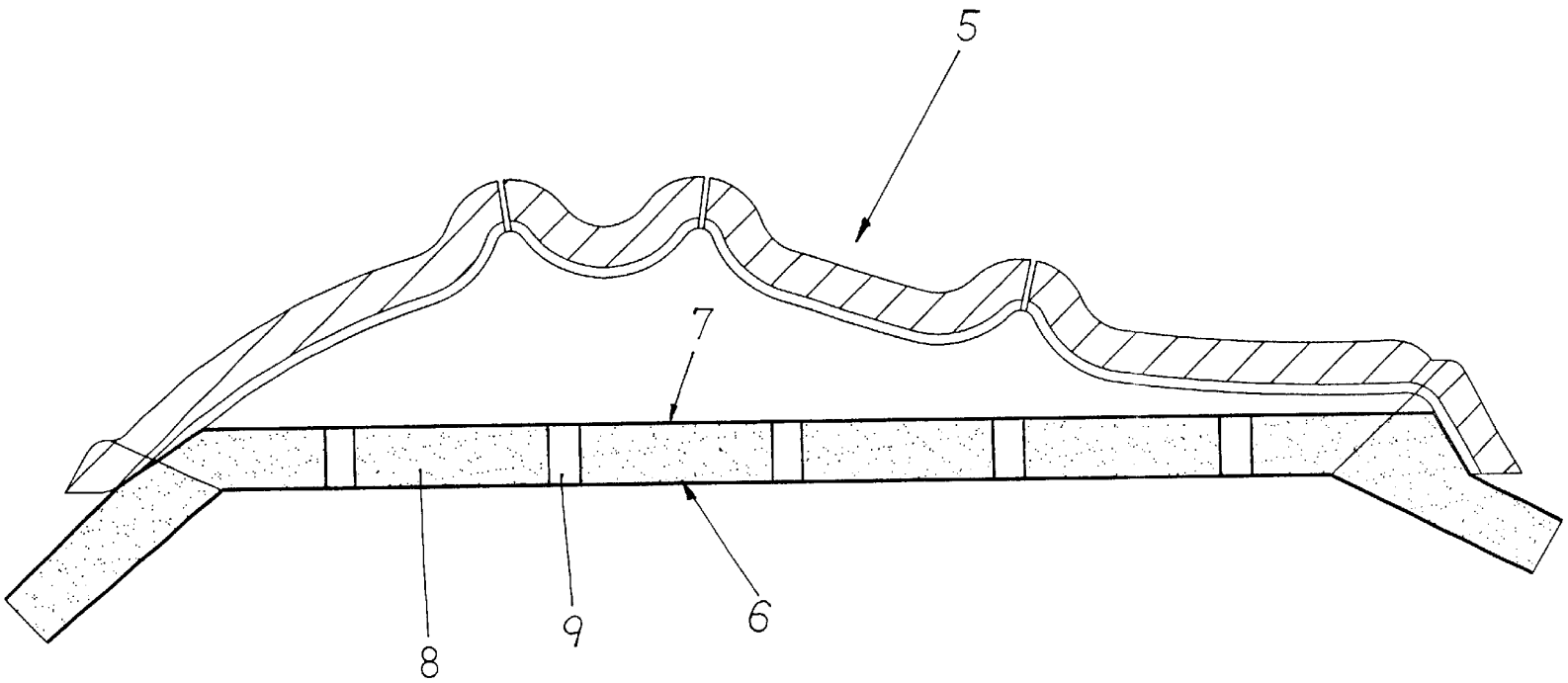
FIG. 9 is a cross-sectional drawing of FIG. 8, as viewed from the perspective of line B—B.

Additionally, the shape of the protective pad 1 of the invention herein can be designed and fabricated in a range of profiles to accommodate the particular area of protective application. As indicated in FIG. 7, an embodiment of the invention herein, the anti-impact rubber cushion 5 remains included in the structural design. Referring to FIG. 8 and FIG. 9, another embodiment of the invention herein, to meet market requirements only the outer surface layer 2 and the anti-impact rubber cushion 5 are sewn together. The outer surface layer 2 still includes an elastic foam sponge 8 cemented between the two interior and exterior fabric 6 and 7, with the design of the elastic foam sponge 8 also including the plurality of aeration holes 9. As such, the structural design provides for excellent anti-impact capability as well as efficient ventilation and body heat transfer.

What is claimed is:

1. A protective pad comprised of an outer surface layer, an inner surface layer, and an anti-impact rubber cushion; said outer surface layer consists of an elastic foam sponge cemented between an interior and an exterior fabric and said inner surface layer consists of an absorbent cotton ply cemented around a shock-buffering foam sponge of an appropriate thickness such that said shock-buffering foam sponge of said inner surface layer is sewn to said outer surface layer to fabricate the safe and comfortable structure of said protective pad, wherein an exterior surface of said anti-impact rubber cushion is contoured by a plurality of flexible bumpers that protrude and are internally hollow, and a perforation is formed in a top of each said flexible bumper.

2. The protective pad as recited in claim 1, wherein said elastic foam sponge at a center of said outer surface layer has a plurality of aeration holes formed therein.

3. A protective pad, comprising:

an outer surface layer including an interior fabric, an exterior fabric, and an elastic sponge adhered between said interior fabric and said exterior fabric;

an inner surface layer including a shock-buffering foam sponge and an absorbent cotton ply adhered around said shock-buffering foam sponge, said shock-buffering foam sponge being attached to said outer surface layer; and an anti-impact rubber cushion attached to said outer surface layer and having an exterior surface that is contoured by a plurality of flexible bumpers that protrude and are internally hollow, with a perforation being formed in a top of each said flexible bumper.

4. An anti-impact rubber cushion disposed on a protective pad, and having an exterior surface that is contoured by a plurality of flexible bumpers that protrude and are internally hollow, with a perforation being formed in a top of each said flexible bumper.

* * * * *